US012604967B2

(12) United States Patent
Lin

(10) Patent No.: US 12,604,967 B2
(45) Date of Patent: Apr. 21, 2026

(54) COSMETIC CONTAINER

(71) Applicant: LIBO COSMETICS CO., LTD., Taichung (TW)

(72) Inventor: Hsiao-Yun Lin, Taichung (TW)

( * ) Notice: Subject to any disclaimer, the term of this patent is extended or adjusted under 35 U.S.C. 154(b) by 0 days.

(21) Appl. No.: 18/513,616

(22) Filed: Nov. 19, 2023

(65) Prior Publication Data

US 2025/0160503 A1 May 22, 2025

(51) Int. Cl.

| | |
|---|---|
| ***A45D 40/22*** | (2006.01) |
| ***A45D 42/00*** | (2006.01) |
| ***B65D 1/34*** | (2006.01) |
| ***B65D 43/16*** | (2006.01) |

(52) U.S. Cl.

CPC ..... *A45D 40/221* (2013.01); *B65D 1/34* (2013.01); *B65D 43/167* (2013.01); *A45D 2040/224* (2013.01); *A45D 42/00* (2013.01); *B65D 2543/00203* (2013.01)

(58) Field of Classification Search

CPC .... A45D 40/221; A45D 40/22; A45D 44/005; A45D 40/24; B65D 1/34; B65D 43/167

USPC ..... 220/845; 206/581, 209, 223

See application file for complete search history.

(56) References Cited

U.S. PATENT DOCUMENTS 1,364,594 A * 1/1921 Thomas ..... A45C 11/00 220/DIG. 26
3,128,898 A * 4/1964 Burman, Jr. ..... A45C 13/005 220/829
3,572,538 A * 3/1971 Bergh ..... A45C 11/24 220/829
3,593,872 A * 7/1971 MacDonald ..... B65D 43/167 220/4.24
6,530,498 B1 * 3/2003 Ovadia ..... A45C 13/007 220/829
6,859,980 B2 * 3/2005 Baer ..... E05D 3/022 16/354
8,881,893 B1 * 11/2014 Cheng ..... A45C 11/04 206/6
2005/0023183 A1 * 2/2005 Banik ..... B65D 77/0486 206/581
2008/0000493 A1 * 1/2008 Anderson ..... A45D 33/22 132/295

FOREIGN PATENT DOCUMENTS

CN 218588445 3/2023

* cited by examiner

*Primary Examiner* — Rafael A Ortiz

(74) *Attorney, Agent, or Firm* — BruceStone LLP; Joseph A. Bruce

(57) ABSTRACT

A cosmetic container includes an internal cover, an internal tray and a hinge. The internal cover is made of metal and includes a frame, two holding elements extending from the frame, and a gap between the holding elements. The internal tray is made of metal and includes a frame, two holding elements extending from the frame of the internal tray, and a gap between the holding elements of the internal tray. The hinge includes two leaves. The first leaf is sandwiched between a face of the internal cover and a face of each of the holding elements of the internal cover. The second leaf is pivotally connected to the first leaf and sandwiched between a face of the internal tray and a face of each of the holding elements of the internal tray.

3 Claims, 8 Drawing Sheets

COSMETIC CONTAINER

BACKGROUND OF INVENTION

1. Field of Invention

The present invention relates to cosmetics and, more particularly, to an environmentally friendly cosmetic container.

2. Related Prior Art

Chinese Patent Application Publication No. 218588445 discloses a well-sealed container for pressed powder. The container includes a box or tray and a cover. The box is formed with an axle. The cover is formed with two lugs. In assembly, the axle is located between the lugs. The includes two ends pivotally connected to the lugs. The axle and the lugs together provide a hinge for pivotally connecting the box to the cover.

Both the box and the cover are made of non-metal material such as polymer and plastics so that it is easy to form the box with the axle, and the cover with the lugs. However, the box and the cover cannot be decomposed and cause serious pollution in the environment.

The present invention is therefore intended to obviate or at least alleviate the problems encountered in the prior art.

SUMMARY OF INVENTION

It is the objective of the present invention to provide an environmentally friendly cosmetic container.

To achieve the foregoing objective, the cosmetic container includes an internal cover, an internal tray and a hinge. The internal cover is made of metal and includes a frame, two clips extending from the frame, and a gap between the clips. The internal tray is made of metal and includes a frame, two clips extending from the frame of the internal tray, and a gap between the clips of the internal tray. The hinge includes two leaves. The first leaf is sandwiched between a face of the internal cover and a face of each of the clips of the internal cover. The second leaf is pivotally connected to the first leaf and sandwiched between a face of the internal tray and a face of each of the clips of the internal tray.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
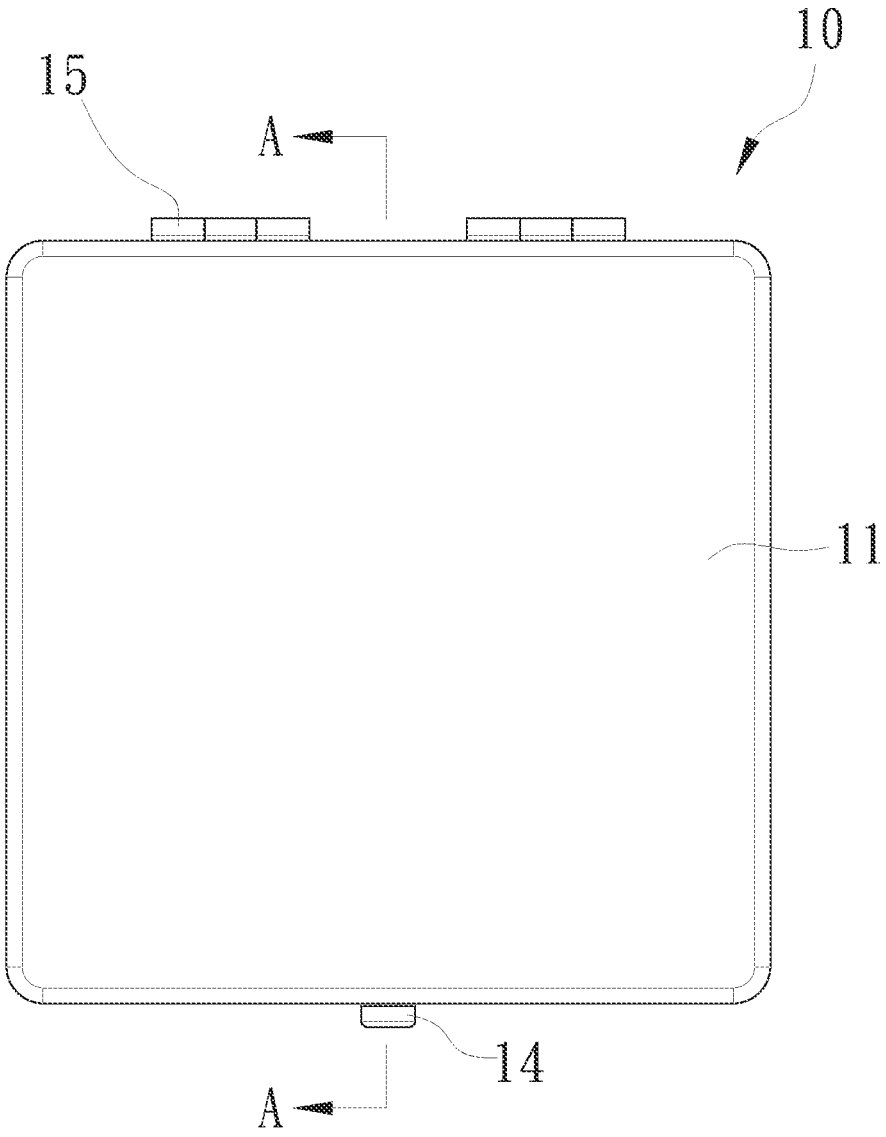
FIG. 1 is a top view of a cosmetic container according to the preferred embodiment of the present invention.
Figure 2:
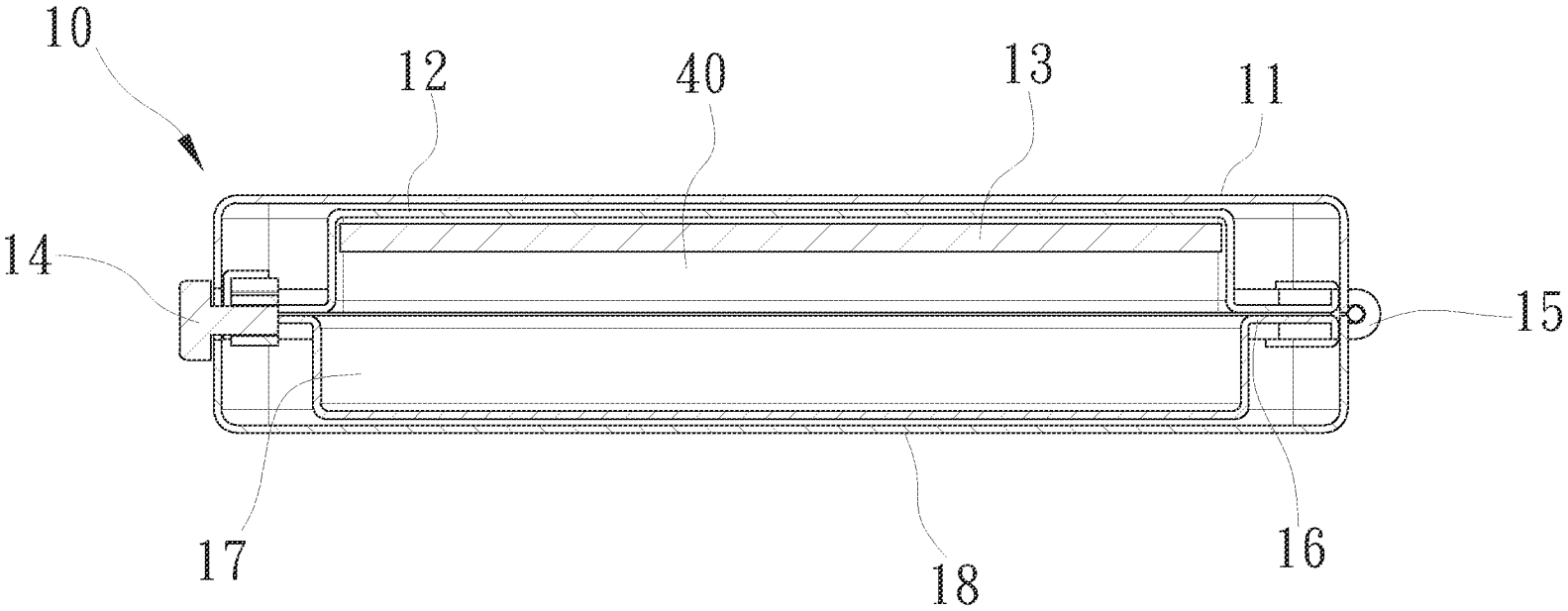
FIG. 2 is a cross-sectional view of the cosmetic container taken along a line A-A shown in FIG. 1.

Referring to FIGS. 1 through 8, a cosmetic container 10 includes an external cover 11, an internal cover 12, an internal tray 16, an external tray 18, two hinges 15, a locking unit 19 and a handle 14 according to the preferred embodiment of the present invention. The above-mentioned elements are made of metal such as aluminum so that they can be recycled and are believed to be more environmentally friendly than plastic ones.

Both the hinges 15 are used to pivotally connect the internal cover 12 to the internal tray 16. Preferably, two hinges 15 are used. However, the internal cover 12 can be pivotally connected to the internal tray 16 with only one hinge 15 in another embodiment.

For briefness and clarity of the following description, only one of the hinges 15 will be described in detail in FIGS. 5 through 8, and will be mentioned as "the" hinge 15. The hinge 15 includes leaves 30 and 33 and a pin 32. The leaf 33 includes two loops 34 formed at an edge.

The leaf 30 includes a loop 31 formed at an edge and two tabs 35 formed at the same edge. The loop 31 is located between the tabs 35.

In assembly, the loop 31 is located between the loops 34. The pin 32 is inserted in the loops 31 and 34. Thus, the leaf 30 is pivotally connected to the leaf 33.

Figure 6:
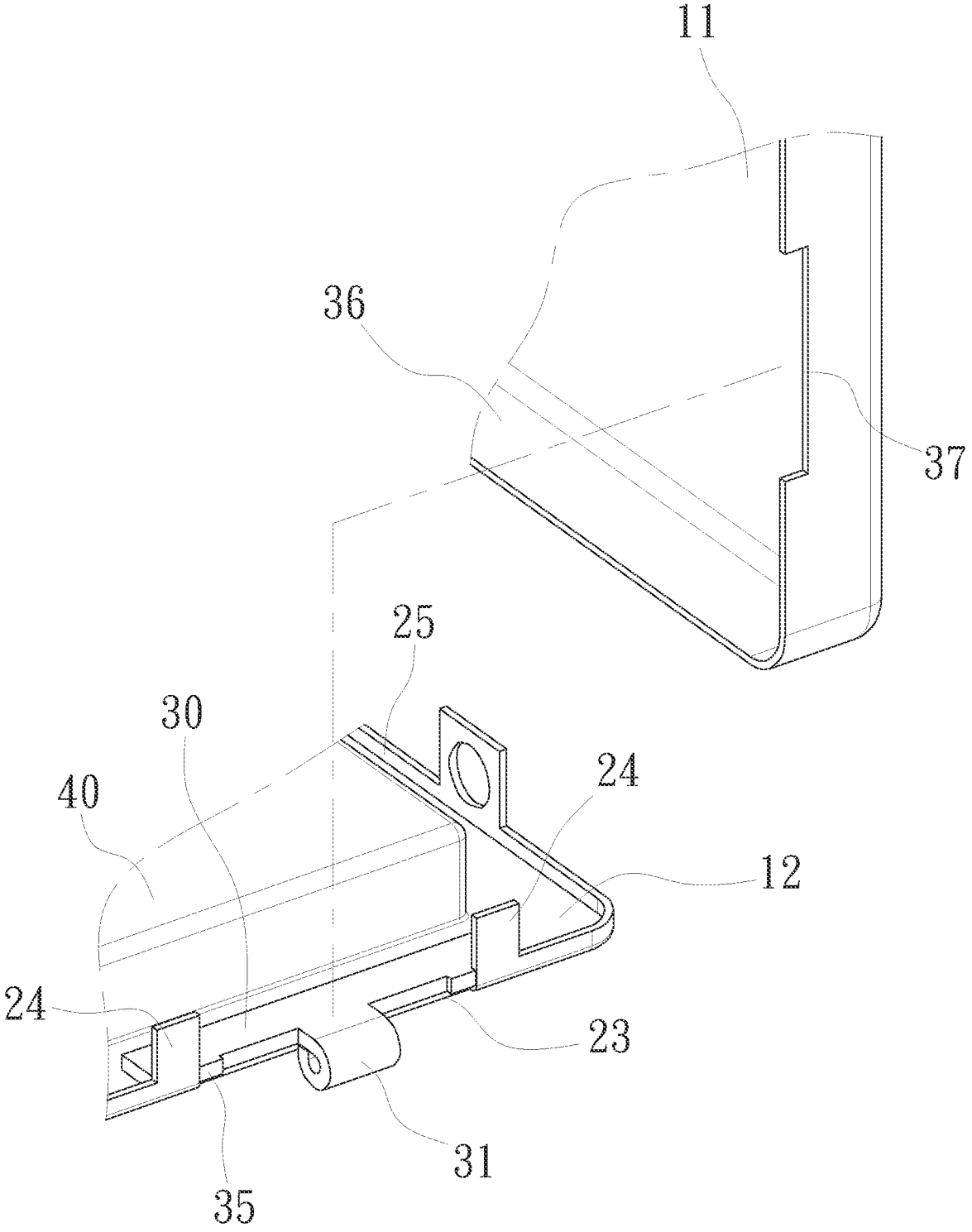
FIG. 6 is an enlarged exploded view of a portion of the cosmetic container shown in FIG. 1.

Referring to FIG. 6, the internal cover 12 includes a frame 25 extending around a plate (not numbered). Preferably, the plate is rectangular. However, the roof can be in any other proper shape in another embodiment.

The internal cover 12 further includes two pairs of clips 24 extending from the frame 25. However, only one of the pairs of clips 24 is shown in FIG. 6. There is a gap 23 between the clips 24. The clips 24 extend rectilinearly when the internal cover 12 is made.

The leaf 30 is in contact with the plate. The tabs 35 are located between the clips 24. Each of the tabs 35 is located against a corresponding one of the clips 24.

Figure 8:
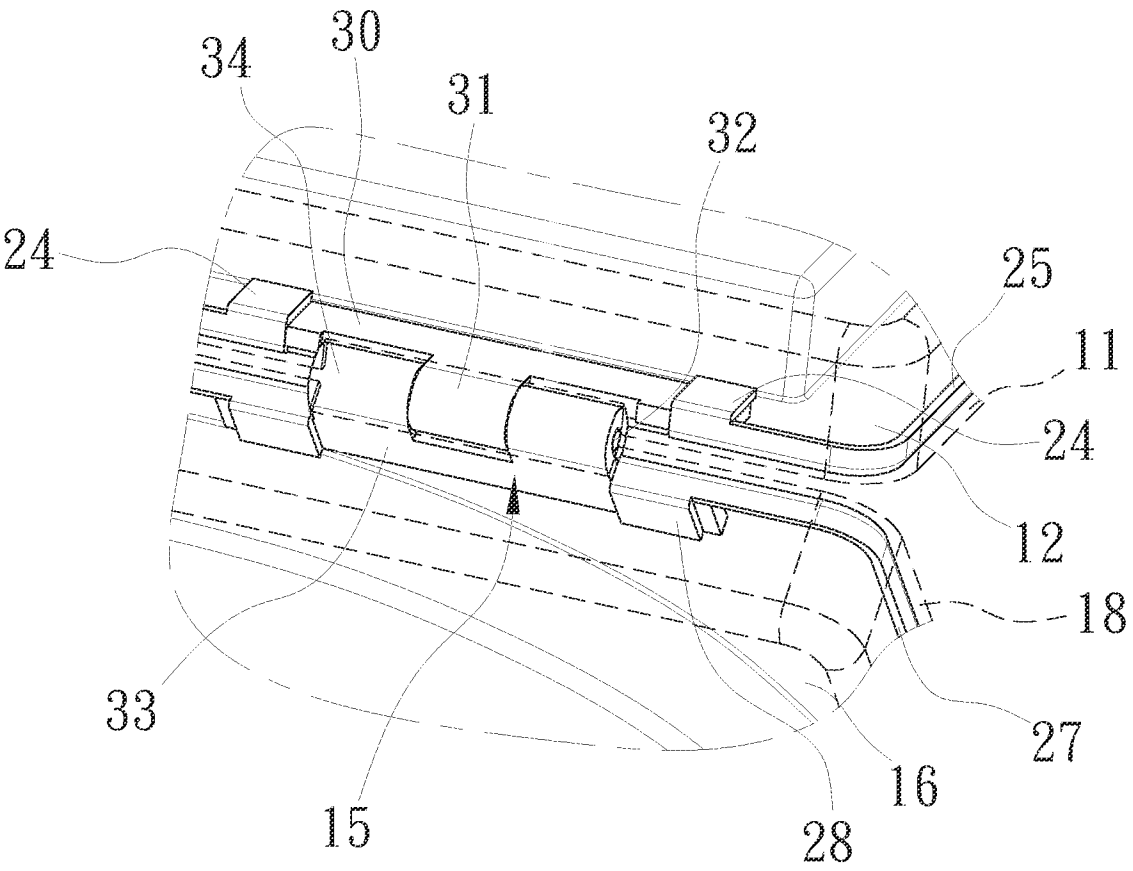
FIG. 8 is an exploded partial view of the cosmetic container shown in FIG. 1.

Referring to FIG. 8, the clips 24 are bent and pressed on the leaf 30. Thus, the leaf 30 is firmly attached to the internal cover 12.

The external cover 11 includes a wall 36 (FIG. 6) extending around a roof (not numbered). The roof is shaped in compliance with the plate. The wall 36 is shaped in compliance with the frame 25. The wall 36 is formed with a cutout 37.

The internal cover 12 is fitted in the external cover 11. The frame 25 is preferably in frictional contact with the wall 36. The loop 31 extends from the combination of the internal cover 12 with the external cover 11 via the cutout 37. Thus, the external cover 11 does not interfere with the operation of the hinge 15.

Figure 7:
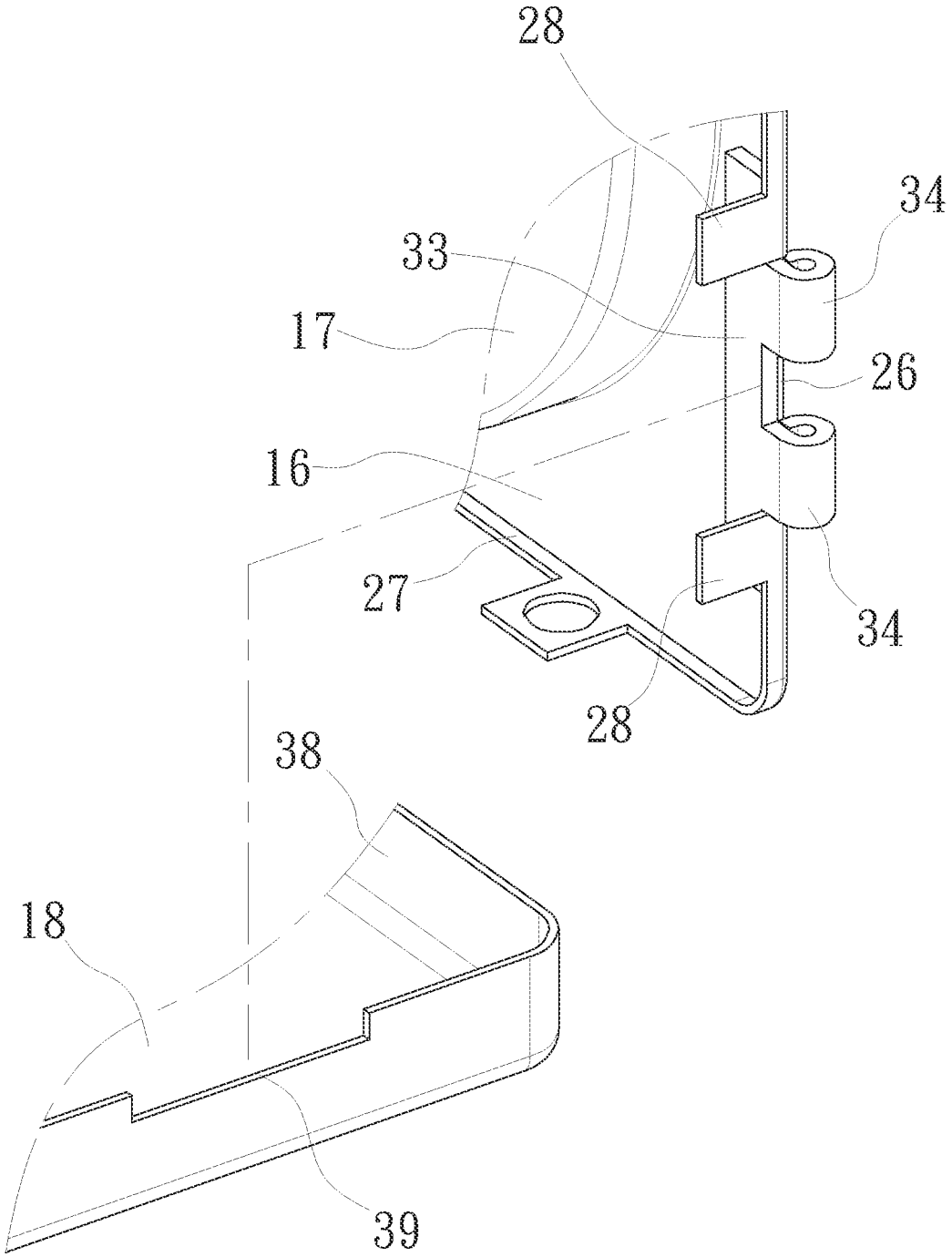
FIG. 7 is an enlarged exploded view of another portion of the cosmetic container shown in FIG. 1.

Referring to FIG. 7, the internal tray 16 includes a frame 27 extending around a plate (not numbered) and a bore 17 in the plate of the internal tray 16. Preferably, the plate of the internal tray 16 is substantially rectangular. However, the plate of the internal tray 16 can be in any other proper shape in another embodiment. The bore 17 is used to receive pressed powder for example.

The internal tray 16 further includes two pairs of clips 28 extending from the frame 25. However, only one of the pairs of clips 28 is shown in FIG. 7. There is a gap 26 between the clips 28. The clips 28 extend rectilinearly when the internal tray 16 is made.

The leaf 30 is in contact with the plate of the internal tray 16. The lugs 34 are located between the clips 28. Each of the lugs 34 is located against a corresponding one of the clips 28.

Referring to FIG. 8, the clips 28 are bent and pressed on the leaf 33. Thus, the leaf 33 is firmly attached to the internal tray 16.

The external tray 18 includes a wall 38 (FIG. 7) extending around a floor (not numbered). The floor is shaped in compliance with the plate of the internal tray 16. The wall 38 is shaped in compliance with the frame 27. The wall 38 is formed with a cutout 39.

The internal tray 16 is fitted in the external tray 18. The frame 27 is preferably in frictional contact with the wall 38. The loops 34 extend from the combination of the internal tray 16 with the external tray 18 via the cutout 39. Thus, the external tray 18 does not interfere with the operation of the hinge 15.

Figure 3:
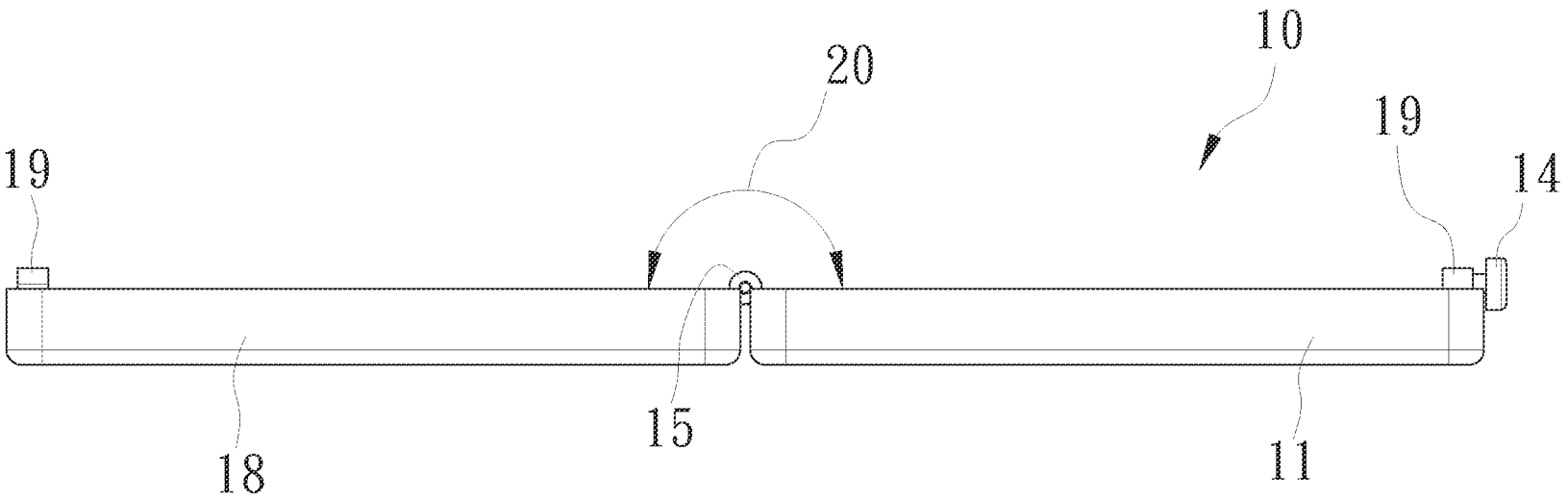
FIG. 3 is a side view of the cosmetic container shown in FIG. 1.
Figure 4:
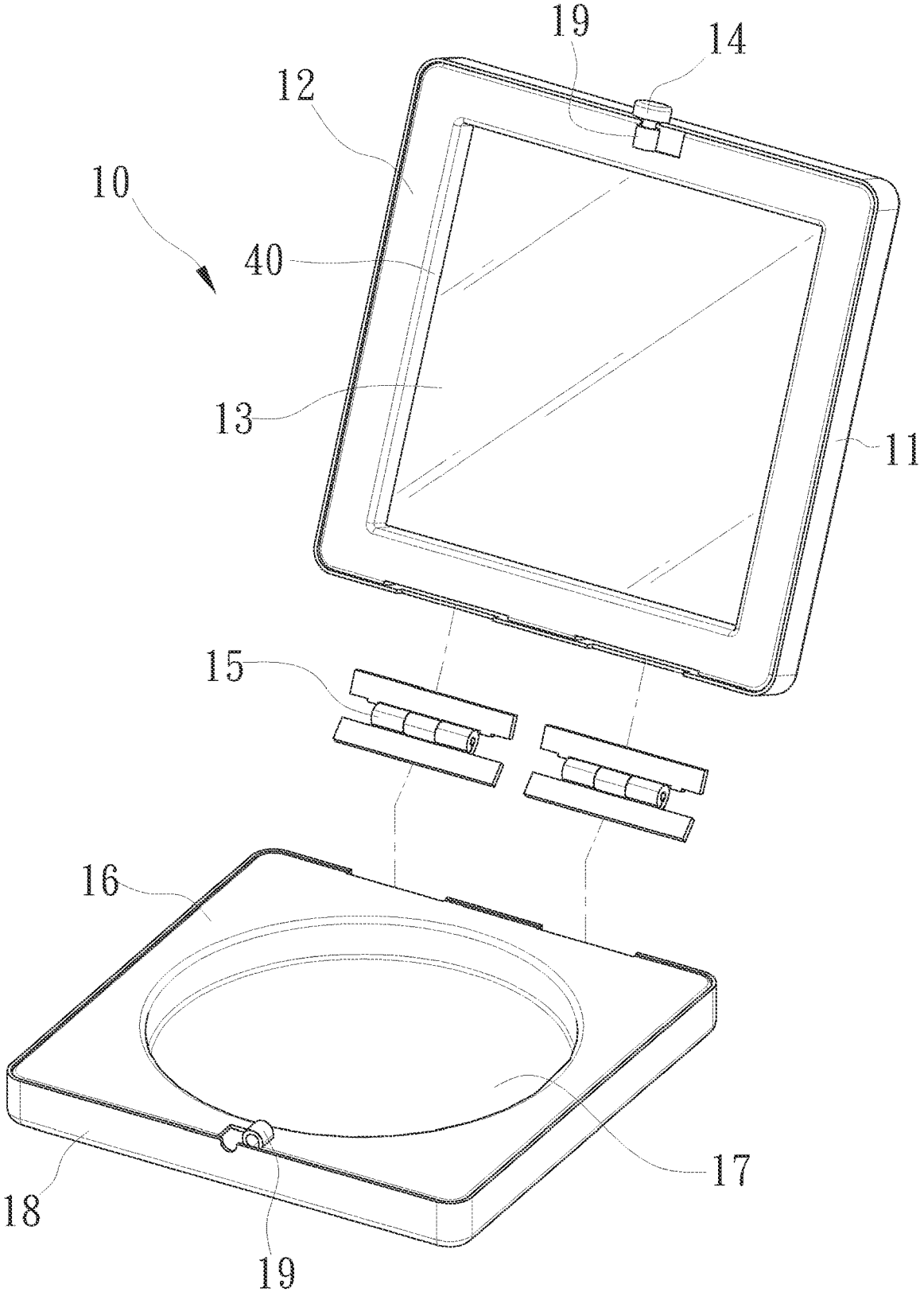
FIG. 4 is an exploded view of the cosmetic container shown in FIG. 1.
Figure 5:
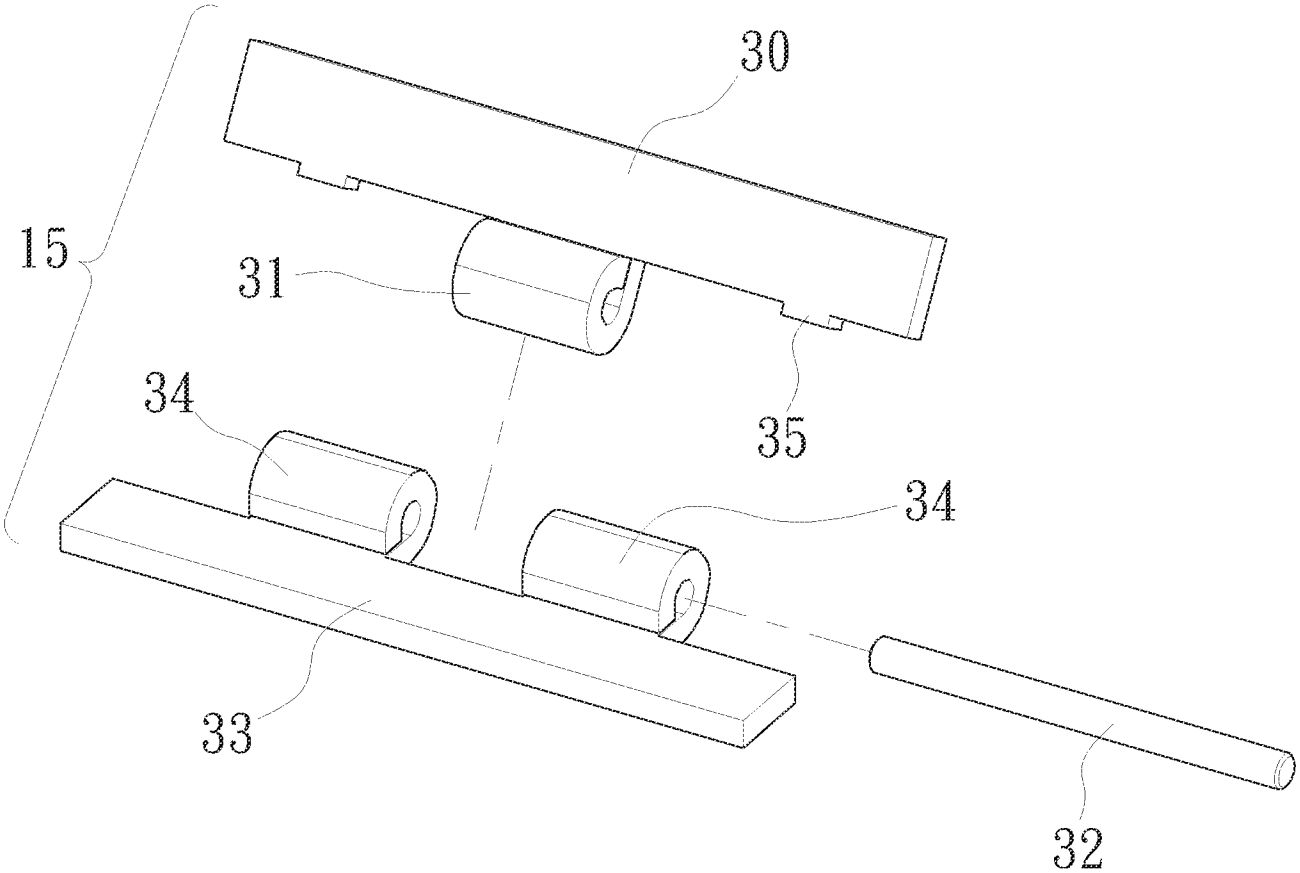
FIG. 5 is an exploded view of a hinge of the cosmetic container shown in FIG. 1.

Referring to FIG. 3, the combination of the internal cover 12 with the external cover 11 is pivotable relative to the combination of the internal tray 16 with the external tray 18. There is an angle 20 between the combinations. The angle 20 varies between a range of 0 to 180 degrees.

The locking unit consists of two elastic semi-rings 19. One of the semi-rings 19 is formed beneath the internal cover 12. The remaining one of the semi-rings 19 is formed on the internal tray 16. The semi-rings 19 are pressed against each other to keep the metal container 10 closed. The internal tray 16 includes a hole (not numbered) to receive the semi-ring 19 that is formed beneath the internal cover 12. The internal cover 12 includes a hole (not numbered) to receive the semi-ring 19 that is formed on the internal tray 16.

To facilitate the pivoting of the combinations relative to each other, a handle 14 is partially inserted in and hence connected to the semi-ring 19 that is formed beneath the internal cover 12.

The metal container 10 further includes a mirror 13 fitted in a recess 40 made in the internal cover 12. A user can look into the mirror 13 and check out his or her look.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A cosmetic container comprising:

an internal cover made of metal and formed with a frame, two clips extending from the frame, and a gap between the clips;

an internal tray made of metal and formed with a frame, two clips extending from the frame of the internal tray, and a gap between the clips of the internal tray;

a hinge comprising:

a first leaf sandwiched between a face of the internal cover and a face of each of the clips of the internal cover, wherein the first leaf comprises a loop extending from the internal cover through the gap of the internal cover;

a second leaf pivotally connected to the first leaf and sandwiched between a face of the internal tray and a face of each of the clips of the internal tray, wherein the second leaf comprises two loops extending from the internal tray tightly through the gap between the clips of the internal tray, wherein the loop of the first leaf is located between the loops of the second leaf; and a pin inserted in the loop of the first leaf and the loops of the second leaf; and an external cover made of metal and formed with a wall for wrapping the frame of the internal cover, wherein the wall comprises a cutout aligned with the gap of the internal cover.

2. The cosmetic container according to claim 1, wherein the first leaf further comprises two tabs located between and against the clips of the internal cover.

3. A cosmetic container comprising:

an internal cover made of metal and formed with a frame, two clips extending from the frame, and a gap between the clips;

an internal tray made of metal and formed with a frame, two clips extending from the frame of the internal tray, and a gap between the clips of the internal tray;

a hinge comprising:

a first leaf sandwiched between a face of the internal cover and a face of each of the clips of the internal cover, wherein the first leaf comprises a loop extending from the internal cover through the gap of the internal cover;

a second leaf pivotally connected to the first leaf and sandwiched between a face of the internal tray and a face of each of the clips of the internal tray, wherein the second leaf comprises two loops extending from the internal tray tightly through the gap between the clips of the internal tray, wherein the loop of the first leaf is located between the loops of the second leaf; and a pin inserted in the loop of the first leaf and the loops of the second leaf; and an external tray made of metal and formed with a wall for wrapping the frame of the internal tray, wherein the wall comprises a cutout aligned with the gap of the internal tray.

* * * * *